US010641020B2

(12) United States Patent
Li et al.

(10) Patent No.: US 10,641,020 B2
(45) Date of Patent: May 5, 2020

(54) ELECTROMAGNETIC RELEASE DOOR CLOSER

(71) Applicant: Oubao Security Technology Co., Ltd., Zhejiang (CN)

(72) Inventors: Haojie Li, Zhejiang (CN); Guowei Jiang, Zhejiang (CN); Qiaojie Liao, Zhejiang (CN); Lijun Ye, Zhejiang (CN)

(73) Assignee: Oubao Security Technology Co., Ltd., Lishui, Zhejiang Province (CN)

( * ) Notice: Subject to any disclaimer, the term of this patent is extended or adjusted under 35 U.S.C. 154(b) by 347 days.

(21) Appl. No.: 15/531,302

(22) PCT Filed: Dec. 8, 2016

(86) PCT No.: PCT/CN2016/108998
§ 371 (c)(1),
(2) Date: May 26, 2017

(87) PCT Pub. No.: WO2017/101732
PCT Pub. Date: Jun. 22, 2017

(65) Prior Publication Data

US 2017/0306668 A1 Oct. 26, 2017

(30) Foreign Application Priority Data

Dec. 16, 2015 (CN) ..... 2015 1 0938015

(51) Int. Cl.
*E05C 17/56* (2006.01)
*E05F 15/60* (2015.01)
(Continued)

(52) U.S. Cl.
CPC ..... *E05C 17/56* (2013.01); *E05C 17/206* (2013.01); *E05F 1/105* (2013.01); *E05F 15/00* (2013.01);
(Continued)

(58) Field of Classification Search
CPC ..... E05C 17/06; E05C 17/206; E05C 17/203; E05C 17/20; E05C 17/56; E05F 15/60;
(Continued)

(56) References Cited

U.S. PATENT DOCUMENTS 4,161,804 A * 7/1979 D'Hooge ..... A62C 2/12 16/48.5
2004/0260284 A1* 12/2004 Parker ..... A61B 17/7032 606/276
2014/0238996 A1* 8/2014 Bergum ..... E05B 65/0003 220/524

FOREIGN PATENT DOCUMENTS

CN 203684908 U 7/2014
CN 203947932 U 11/2014
(Continued)

*Primary Examiner* — Nathan Cumar
(74) *Attorney, Agent, or Firm* — Muncy, Geissler, Olds & Lowe, P.C.

(57) ABSTRACT

The present invention relates to the technical field of door closers, and particularly discloses an electromagnetic release door closer. The electromagnetic release door closer comprises a door closer body, a slide rail, and a rocker arm, one end of the rocker arm is articulated with the door closer body, wherein the slide rail is provided with a slide groove and a slide cavity which are parallel to each other, a through slot which is parallel to the slide groove is arranged between the slide groove and the slide cavity, wherein an electromagnetic limiting mechanism can be fixed at any position in the slide cavity. In the electrified state of an electromagnet, an electromagnetic attracting plate and the electromagnet are in a fixed state under the action of magnetic force, a limiting latch bolt is located in the slide groove, and is used to limit the sliding of a slider in the slide groove, and under this state, the slider can slide freely between the limiting latch bolt and one end of the slide groove, that is, a door leaf can move freely between a position limited by the limiting latch bolt
(Continued)

and a maximum opening position. The defect that a door leaf can only be fixed in one specific state in the prior art is overcome, the range of adjustment is wider, and the electromagnetic release door closer is more convenient to use, and can meet more use requirements.

17 Claims, 5 Drawing Sheets

(51) Int. Cl.

| | |
|---|---|
| ***E05F 15/00*** | (2015.01) |
| ***E05F 1/10*** | (2006.01) |
| ***E05F 15/63*** | (2015.01) |
| ***E05C 17/20*** | (2006.01) |

(52) U.S. Cl.
CPC ..... *E05F 15/60* (2015.01); *E05F 15/63* (2015.01); *E05F 2015/631* (2015.01); *E05Y 2201/462* (2013.01)

(58) Field of Classification Search
CPC ..... E05F 15/603; E05F 15/63; E05F 1/105; E05F 1/1041; E05F 1/1058; E05F 2015/631; E05F 15/00; E05F 15/611; E05F 1/1246; E05Y 2201/462
USPC ..... 292/251.5
See application file for complete search history.

(56) References Cited

FOREIGN PATENT DOCUMENTS

| | | | |
|---|---|---|---|
| CN | 204139819 | U | 2/2015 |
| CN | 104895440 | A | 9/2015 |
| EP | 1473431 | A1 | 11/2004 |

* cited by examiner

ELECTROMAGNETIC RELEASE DOOR CLOSER

FIELD OF THE INVENTION

The present invention relates to the technical field of door closers, and in particular to an electromagnetic release door closer.

BACKGROUND OF THE INVENTION

Door closers are mainly applied to fireproof doors in commercial and public buildings. Besides having the function of ordinary doors, fireproof doors also have the function of preventing the spread of fire and smoke, and can prevent the spread of fire within a certain period of time, ensuring that people canevacuate. Fireproof doors usually include a normally closed fireproof door and a normally opened fireproof door, wherein the normally opened fireproof door normally keeps an opened state, so that people can pass through conveniently and ventilation and daylighting are convenient, the normally opened fireproof door can close automatically under a fire situation, playing the role of blocking smoke and fire, consequently, the problems of inconvenience brought to the passage of people by that the fireproof door is closed normally and the artificial damage to the fireproof door caused by frequent opening and closing are solved thoroughly, and moreover, fire safety is also guaranteed.

Under the opened state of a currently common normally opened fireproof door, a door closer will usually fix the door at an extreme opening position or fix the door at any position between the extreme opening position and a closing position. Under the normal use state of such a normally opened fireproof door, both the opening angle and position of a door leaf cannot be adjusted, the opening degree of the door cannot be adjusted at any time according to environmental change or use requirements, so the flexibility is poor.

SUMMARY OF THE INVENTION

The technical problem to be solved by the present invention is to solve the defect that the opening angle and position of the door leaf of the normally opened fireproof door cannot be adjusted in the prior art.

In order to solve the above-mentioned technical problem, the technical solution provided by the present invention is as follows: disclosed is an electromagnetic release door closer, comprising a door closer body, a slide rail, and a rocker aim, one end of the rocker arm being articulated with the door closer body, and characterized in that the upper surface of the slide rail is provided with a slide groove, the interior of the slide rail is provided with a slide cavity parallel to the slide groove, a through slot which is parallel to the slide groove is arranged between the slide slot and the slide cavity, and the width of the through slot is less than the widths of the slide groove and the slide cavity; one end, which is far from the door closer body, of the rocker aim is connected with a slider for sliding in the slide groove, and the rocker aim and the slider are in rotatable and movable connection; an electromagnetic limiting mechanism which can slide in the slide cavity is arranged in the slide cavity, the electromagnetic limiting mechanism comprises an electromagnet and an electromagnetic attracting plate, the center of the electromagnet is provided with a guide hole running through the electromagnet, both ends of the electromagnet are provided with threaded fastening holes, and fastening bolts are connected into the threaded fastening holes; a limiting latch bolt is arranged in the guide hole, the limiting latch bolt is connected with the electromagnetic attracting plate through a screw, the screw is connected fixedly with the limiting latch bolt, and the screw and the electromagnetic attracting plate are connected movably with each other along the axial direction of the screw; a first spring is arranged between the limiting latch bolt and the electromagnetic attracting plate, a second spring is arranged between the electromagnetic attracting plate and the bottom of the slide cavity, the second spring abuts against the bottom of the slide cavity, and the strength of the first spring is higher than the strength of the second spring.

In the electromagnetic release door closer of the present invention, the slide rail is provided with a slide groove and a slide cavity which are parallel to each other, a through slot which is parallel to the slide groove is arranged between the slide groove and the slide cavity, wherein an electromagnetic limiting mechanism can be fixed at any position in the slide cavity. In the electrified state of an electromagnet, an electromagnetic attracting plate and the electromagnet are in a fixed state under the action of magnetic force, a limiting latch bolt is located in the slide groove, and is used to limit the sliding of a slider in the slide groove, and under this state, the slider can slide freely between the limiting latch bolt and one end of the slide groove, that is, a door leaf can move freely between a position limited by the limiting latch bolt and a maximum opening position. The defect that a door leaf can only be fixed in one specific state in the prior art, the range of adjustment is wider, and the electromagnetic release door closer is more convenient to use, and can meet more use requirements.

Moreover, because the strength of the first spring is enough to ensure that the first spring cannot be compressed to make the slider pass through the limiting latch bolt under the normally opened state of the door leaf, when the door leaf receives great impact force, the slider will drive the limiting latch bolt to compress the first spring until the slider passes through the limiting latch bolt, and thereby the door closer device can be prevented from being damaged when the door leaf receives great impact force.

Under the power-off state of the electromagnet, the electromagnetic attracting plate is separated from the electromagnet, and since the strength of the second spring is low, when the door is opened or closed normally, the slider can drive the limiting latch bolt to compress the second spring until the slider passes through the limiting latch bolt, that is, the door leaf can be opened or closed freely.

DETAILED DESCRIPTION OF THE INVENTION

Figure 1:
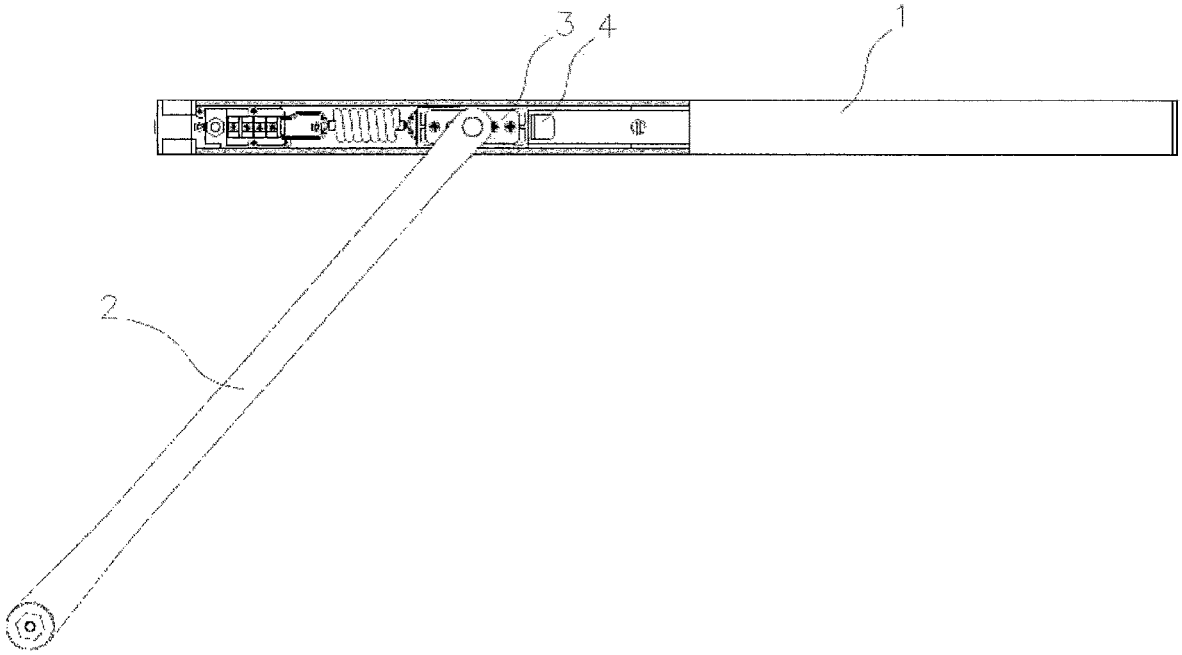
FIG. 1 is a structural schematic diagram of an electromagnetic release door closer of the present embodiment.
Figure 2:
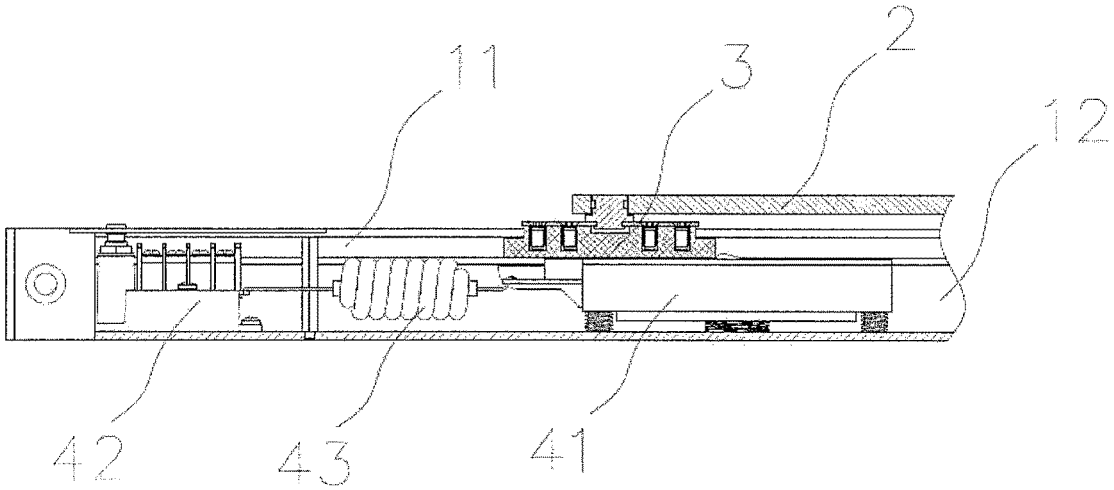
FIG. 2 is a partial cross-sectional diagram of the electromagnetic release door closer shown in FIG. 1.

In order to make the objective, technical solution and advantages of the present invention clearer, the present invention is further described in detail below in reference to drawings and embodiments. It should be understood that the specific embodiment described herein is only used to explain the present invention rather than to limit the present invention.

As shown in FIGS. 1-4 and FIG. 9, an electromagnetic release door closer of the present embodiment comprises a door closer body 5, a slide rail 1, and a rocker arm 2. The upper surface of the slide rail 1 is provided with a slide groove 11, the interior of the slide rail 1 is provided with a slide cavity 12 which is parallel to the slide groove 11, wherein a through slot 10 which is parallel to the slide groove 11 is arranged between the slide groove 11 and the slide cavity 12, and the width of the through slot 10 is less than the widths of the slide grooves 11 and the slide cavity 12.

One end of the rocker arm 2 of the present embodiment is connected with a slider 3 for sliding in the slide groove 11, and the rocker arm 2 and the slider 3 are in rotatable and movable connection. As a biggest improvement of the present embodiment, a limiting device 4 which can slide in the slide cavity 12 is arranged in the slide cavity 12, wherein the limiting device 4 comprises an electromagnetic limiting mechanism 41, a control circuit module 42 located at the end of the slide cavity, and a spring wire 43 for connecting the electromagnetic limiting mechanism 41 with the control circuit module 42, wherein the elasticity of the spring wire 43 makes the movement of the electromagnetic limiting mechanism 41 in the slide cavity 12 possible.

Figure 3:
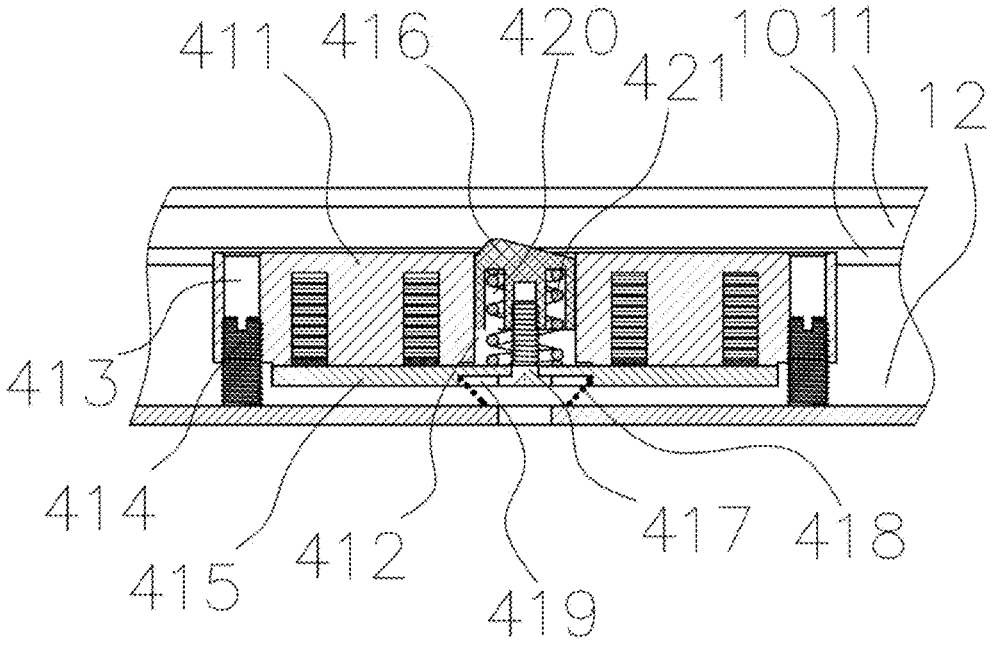
FIG. 3 is a structural schematic diagram of an electromagnetic limiting mechanism in the electromagnetic release door closer of the present embodiment.

As shown in FIG. 3, the electromagnetic limiting mechanism 41 of the present embodiment comprises an electromagnet 411 and an electromagnetic attracting plate 415, wherein the center of the electromagnet 411 is provided with a guide hole 412 running through the electromagnet, both ends of the electromagnet 411 are provided with threaded fastening holes 413, and fastening bolts 414 are connected into the threaded fastening holes 413. In the process of screwing down the fastening bolts 414, the upper surface of the electromagnet 411 is gradually getting close to the top surface of the slide cavity 12 until being pressed tightly, and thereby the electromagnetic limiting mechanism 41 is fixed at any position in the slide cavity 12.

In the present embodiment, a limiting latch bolt 416 is arranged in the guide hole 412, the limiting latch bolt 416 is connected with the electromagnetic attracting plate 415 through a screw 417, wherein the screw 417 is connected fixedly with the limiting latch bolt 416, and the screw 417 and the electromagnetic attracting plate 415 are connected movably with each other along the axial direction of the screw. Under the electrified state of the electromagnet 411, the electromagnetic attracting plate 415 is connected fixedly to the electromagnet under the action of electromagnetic force, the limiting latch bolt 416 gets into the slide groove 11 via the through slot 10, and thereby the slider 3 is limited from passing through the position of the limiting latch bolt 416.

As a major improvement of the present embodiment, a first spring 421 is arranged between the limiting latch bolt 416 and the electromagnetic attracting plate 415, and a second spring 418 is arranged between the electromagnetic attracting plate 415 and the bottom of the slide cavity 12. As a preference, one side, which is close to the electromagnetic attracting plate 415, of the limiting latch bolt 416 is provided with an annular containing groove 420, wherein one end of the first spring 421 is located in the annular containing groove 420, and the other end abuts against the electromagnetic attracting plate 415; one side, which is far from the sloped limiting tongue 416, of the electromagnetic attracting plate 415 is provided with a counterbore 419, wherein one end of the second spring 418 is located in the counterbore, and the other end abuts against the bottom of the slide cavity 12.

What needs to be explained is that the strength of the first spring 421 is higher than the strength of the second spring 418. The strength of the first spring 421 is enough to ensure that the first spring 421 cannot be compressed under the normally opened state of the door leaf, so that the slider 3 cannot pass through the limiting latch bolt 416. Under this state, the slider 3 can slide freely between the limiting latch bolt 416 and one end of the slide groove 11, that is, the door leaf can move freely between a position limited by the limiting latch bolt 416 and a maximum opening position, consequently, the defect that the door leaf can only be fixed in one specific state in the prior art is changed, the range of adjustment is wider, and the electromagnetic release door closer is more convenient to use, and can meet more use requirements. When the door leaf receives great impact force, the impact force is great enough to make the slider 3 drive the limiting latch bolt 416 to compress the first spring 421 until the slider 3 passes through the limiting latch bolt 416, and thereby the door closer device can be prevented from being damaged when the door leaf receives great impact force.

Under the power-off state of the electromagnet 411 of the electromagnetic release door closer of the present embodiment, the electromagnetic attracting plate 415 is separated from the electromagnet 411, and since the strength of the second spring 418 is low, when the door is opened or closed normally, the slider 3 can drive the limiting latch bolt 416 to compress the second spring 418 until the slider 3 passes through the limiting latch bolt 416, that is, the door leaf can be opened or closed freely.

Figure 4:
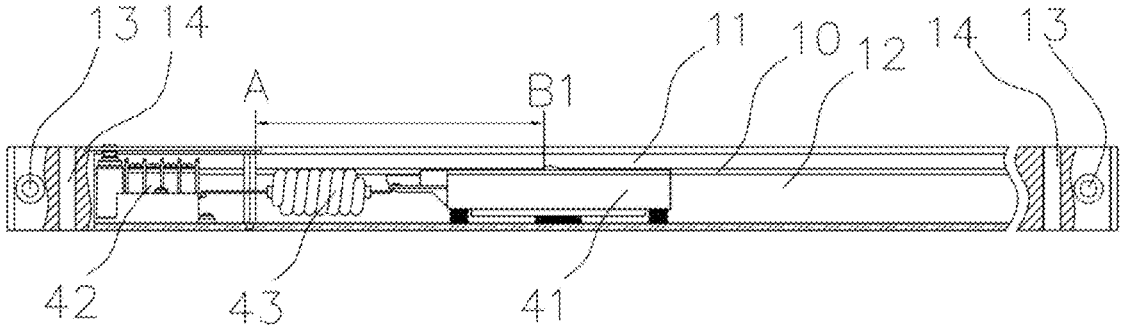
FIG. 4 is a structural schematic diagram of the electromagnetic limiting mechanism in a first state in the electromagnetic release door closer of the present embodiment.

Under the state shown in FIG. 4, the limiting latch bolt 416 is located at a position B1, then the slider 3 can move freely between an extreme position A and the position B1, that is, the door leaf can be opened and closed between the maximum opening position and the position B1 limited by the limiting latch bolt. Likewise, under the state shown in FIG. 5, when the limiting latch bolt 416 is fixed at a position B2, the slider 3 can move freely between the extreme position A and the position B2, that is, the door leaf can be opened and closed between the maximum opening position and the position B2 limited by the limiting latch bolt.

Figure 5:
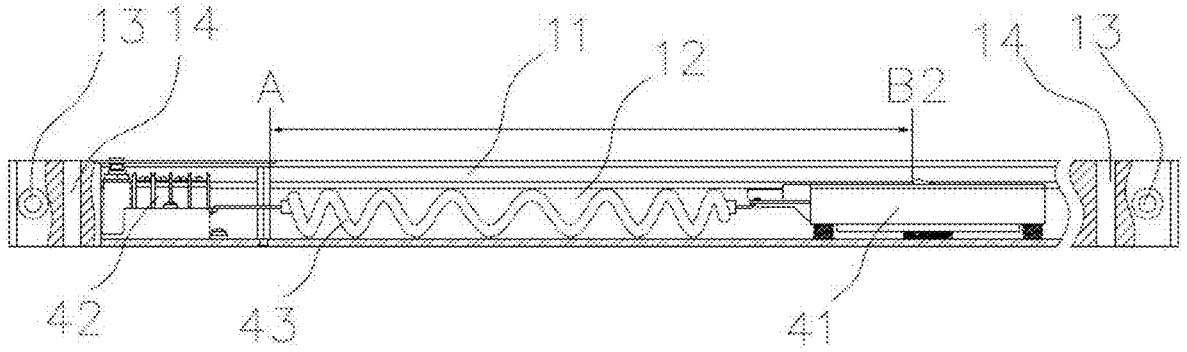
FIG. 5 is a structural schematic diagram of the electromagnetic limiting mechanism in a second state in the electromagnetic release door closer of the present embodiment.
Figure 6:
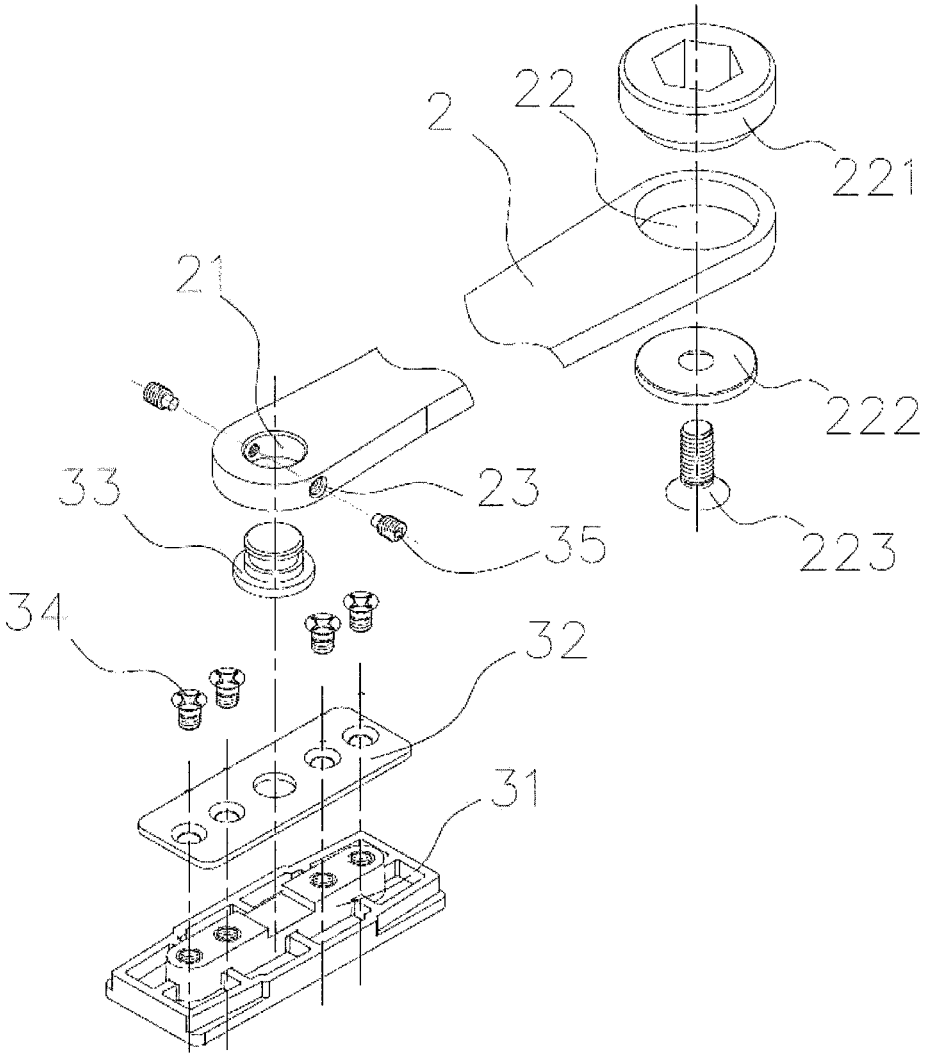
FIG. 6 is a schematic connection diagram of the connected end of a rocker arm in the electromagnetic release door closer of the present embodiment.

Further, as shown in FIG. 5 and FIG. 6, in the electromagnetic release door closer of the present embodiment, both ends of the slide rail 1 are provided with a horizontal mounting hole 13 and a vertical mounting hole 14 which are perpendicular to each other. Consequently, the electromagnetic release door closer of the present embodiment not only can be mounted on the top of the door leaf, but also can be mounted on the side of the door leaf, moreover, the direction does not need to be turned when the electromagnetic release door closer is mounted on the door leaf in different directions, and thereby the electromagnetic release door closer of the present embodiment can be mounted suitably on more types of doors.

Figure 9:
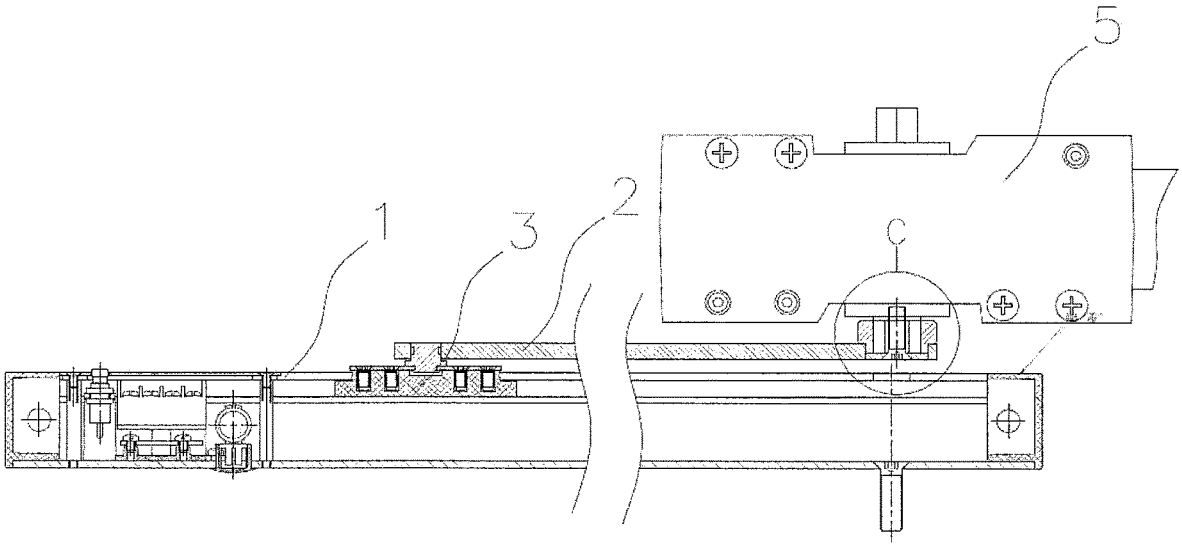
FIG. 9 is the electromagnetic release door closer of the present embodiment and a schematic mounting diagram of the door closer.

FIG. 9 shows a schematic diagram of the mounting state of the electromagnetic release door closer of the present embodiment, wherein the slide rail is mounted on the top of the door leaf, and the door closer body 5 is mounted on a doorframe. In the process of mounting this type, in order to reduce the mounting gap between the doorframe and the top of the door leaf as much as possible and reduce the size of the doorframe, the connecting structures of both ends of the rocker arm 2 of the electromagnetic release door closer of the present embodiment are specially designed.

Figure 7:
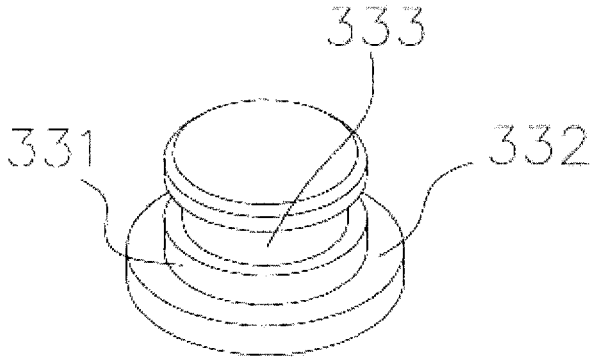
FIG. 7 is a structural schematic diagram of a rocker arm shaft in the electromagnetic release door closer of the present embodiment.
Figure 8:
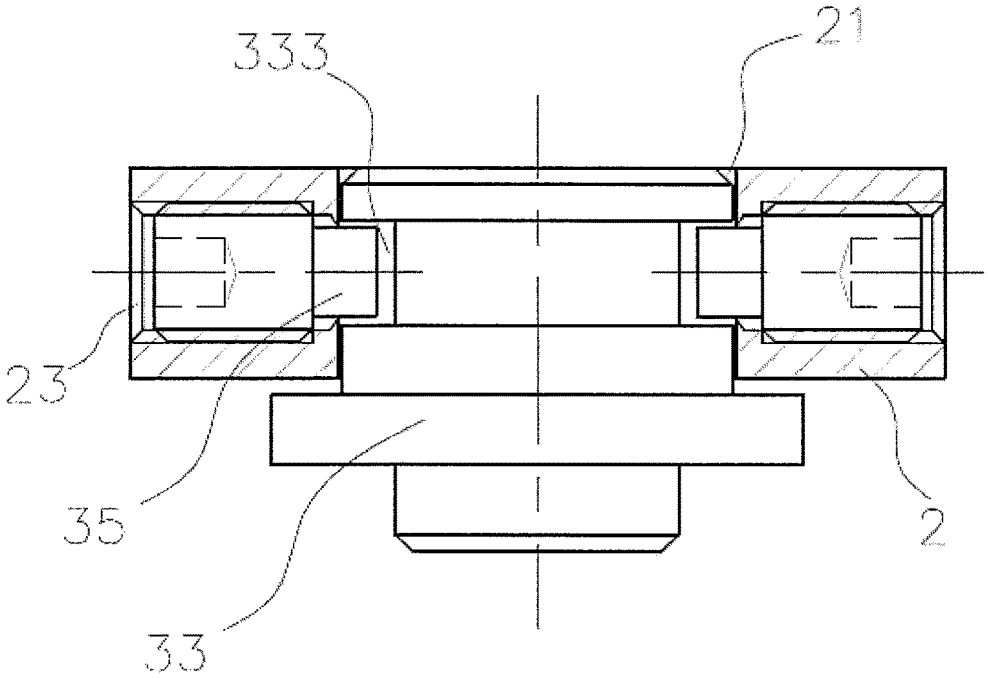
FIG. 8 is a schematic diagram of connection state between the rocker arm and the rocker arm shaft in the electromagnetic release door closer of the present embodiment.

One end, which is connected with the slider 3 of the rocker arm 2 is shown in FIGS. 6-8, wherein the end, which is connected with the slider, of the rocker arm 2 is provided with a first connecting hole 21 running through the rocker arm 2, and the sidewall of the first connecting hole 21 is provided with at least two threaded holes 23 which are perpendicular to the first connecting hole 21 and run through the sidewall of the first connecting hole 21. The rocker arm 2 is connected with the slider 3 through a rocker arm shaft 33, wherein the rocker arm shaft 33, which is shown in FIG. 7, comprises a columnar connecting portion 331 and an annular ledge 332, and the columnar connecting portion 331 is provided with an annular groove 333. The slider 3 comprises a slider body 31 and a cover plate 32, the cover plate 32 is connected with the slider body 31 through bolts 34, and moreover, the annular ledge 332 of the rocker aim shaft 33 is located between the cover plate 32 and the slider body 31, and is connected fixedly relative to the slider 3. As shown in FIG. 8, the end, which is provided with the annular groove 333, of the rocker arm shaft 33 extends into the first connecting hole 21 of the rocker arm 2, and under this state, the position of the annular groove 333 in the first connecting hole 21 is as high as the threaded holes 23. Studs 35 are then screwed into the threaded holes 23; under the connected state, one end, which is far from the slider 3, of the rocker arm shaft 33 is not higher than the upper surface of the rocker arm 2, one end of each stud 35 is located in the annular groove 333, and the other end is not higher than the sidewall surface of the rocker arm 2.

Figure 10:
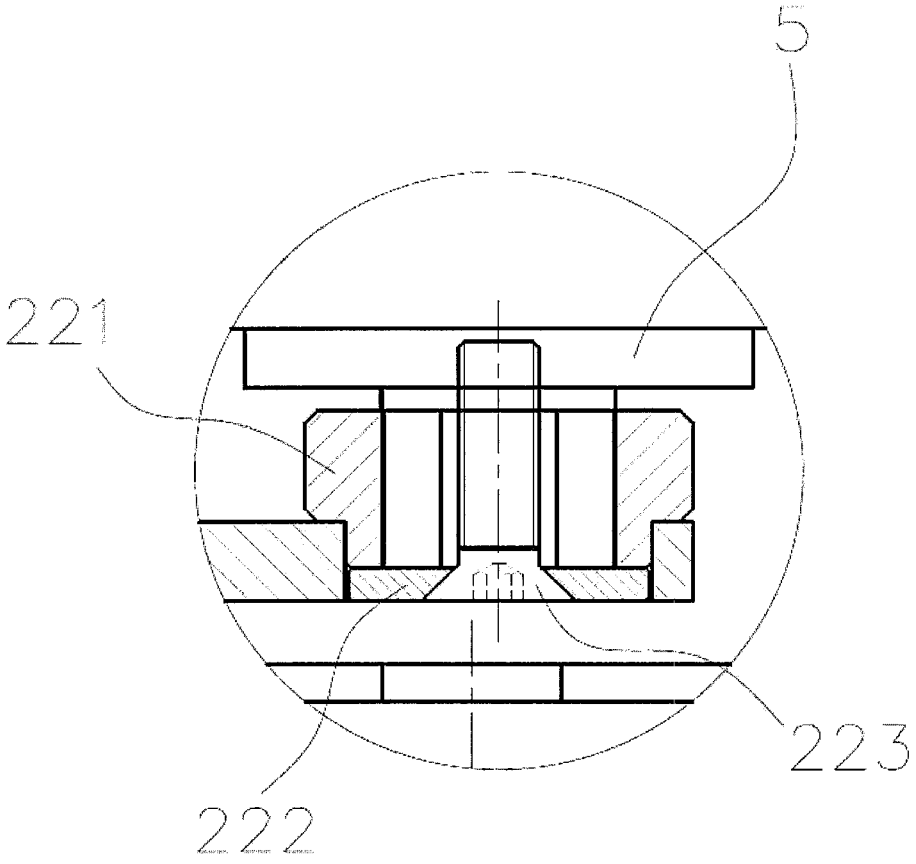
FIG. 10 is a schematic connection diagram of the joint between the rocker aim in the electromagnetic release door closer and the door closer of the present embodiment.

Further, as shown in FIG. 6 and FIG. 10, one end, which is far from the slider 3, of the rocker arm 2 is provided with a second connecting hole 22 running through the rocker aim 2, the rocker arm 2 is connected fixedly with the door closer body 5 through a hexagonal tenon 221 and a bolt 223, one end of the hexagonal tenon 221 extends into the second connecting hole 22 and is connected fixedly with the rocker arm 2, and preferably, the edge is welded on the rocker arm 2. The length of extension of the hexagonal tenon 221 into the second connecting hole 22 is less than the axial length of the second connecting hole 22, and a countersink washer 222 is arranged in one side, which is far from the hexagonal tenon, of the second connecting hole 22. Under the connected state, the countersink washer 222 is located completely in the second connecting hole 22, and will not protrude out of the surface of the rocker arm 2.

In the connecting structures of both ends of the rocker arm 2, the rocker arm shaft, the studs and the countersink washer all do not protrude out of the surface of the rocker arm, so that the height of the door closer product is small after mounting is complete, and thereby the gap between the doorframe and the door leaf is reduced effectively.

In a word, what is described above is merely the preferred embodiment of the present invention, and is not used to limit the present invention, and any modifications, equivalent replacement, improvements and the like which are made within the spirit and principle of the present invention shall fall within the protection scope of the present invention.

What is claimed is:

1. An electromagnetic release door closer, comprising a door closer body, a slide rail, and a rocker arm, one end of the rocker arm being articulated with the door closer body, and wherein an upper surface of the slide rail is provided with a slide groove, the interior of the slide rail is provided with a slide cavity parallel to the slide groove, a through slot which is parallel to the slide groove is arranged between the slide groove and the slide cavity; one end of the rocker arm which is far from the door closer body is connected with a slider for sliding in the slide groove, and the rocker arm and the slider are in rotatable and movable connection; an electromagnetic limiting mechanism which can slide in the slide cavity is arranged in the slide cavity, the electromagnetic limiting mechanism comprises an electromagnet and an electromagnetic attracting plate, the center of the electromagnet is provided with a guide hole running through the electromagnet, both ends of the electromagnet are provided with threaded fastening holes, and fastening bolts are connected into the threaded fastening holes; a limiting latch bolt is arranged in the guide hole, the limiting latch bolt is connected with the electromagnetic attracting plate through a screw, the screw is connected fixedly with the limiting latch bolt, and the screw and the electromagnetic attracting plate are connected movably with each other along the axial direction of the screw; a first spring is arranged between the limiting latch bolt and the electromagnetic attracting plate, a second spring is arranged between the electromagnetic attracting plate and the bottom of the slide cavity, the second spring abuts against the bottom of the slide cavity;

wherein one side, which is close to the electromagnetic attracting plate, of the limiting latch bolt is provided with an annular containing groove, one end of the first spring is located in the annular containing groove, and the other end abuts against the electromagnetic attracting plate;

wherein a control circuit module is arranged at one end of the slide cavity, and the control circuit module is connected with the electromagnetic limiting mechanism through a spring wire; and wherein a rocker arm shaft is arranged between the rocker arm and the slider, the rocker arm shaft is provided with an annular groove, one end of the rocker arm shaft is connected fixedly with the slider, the end with the annular groove extends into a first connecting hole of the rocker arm, and under this state, the position of the annular groove in the first connecting hole is as high as threaded holes; studs are connected into the threaded holes; under the connected state, one end, which is far from the slider, of the rocker arm shaft is not higher than the upper surface of the rocker arm, one end of each stud is located in the annular groove, and the other end is not higher than a sidewall surface of the rocker arm.

2. The electromagnetic release door closer according to claim 1, wherein one side, which is far from the limiting latch bolt, of the electromagnetic attracting plate is provided with a counterbore, and one end of the second spring is located in the counterbore.

3. The electromagnetic release door closer according to claim 2, wherein a control circuit module is arranged at one end of the slide cavity, and the control circuit module is connected with the electromagnetic limiting mechanism through a spring wire.

4. The electromagnetic release door closer according to claim 2, wherein both ends of the slide rail are provided with a horizontal mounting hole and a vertical mounting hole which are perpendicular to each other.

5. The electromagnetic release door closer according to claim 1, wherein one side, which is far from the limiting latch bolt, of the electromagnetic attracting plate is provided with a counterbore, and one end of the second spring is located in the counterbore.

6. The electromagnetic release door closer according to claim 1, wherein a control circuit module is arranged at one end of the slide cavity, and the control circuit module is connected with the electromagnetic limiting mechanism through a spring wire.

7. The electromagnetic release door closer according to claim 6, wherein both ends of the slide rail are provided with a horizontal mounting hole and a vertical mounting hole which are perpendicular to each other.

8. The electromagnetic release door closer according to claim 6, wherein one end, which is connected with the slider, of the rocker arm is provided with a first connecting hole running through the rocker arm, and the sidewall of the first connecting hole is provided with at least two threaded holes which are perpendicular to the first connecting hole and run through the sidewall of the first connecting hole.

9. The electromagnetic release door closer according to claim 8, wherein a rocker arm shaft is arranged between the rocker arm and the slider, the rocker arm shaft is provided with an annular groove, one end of the rocker arm shaft is connected fixedly with the slider, the end with the annular groove extends into the first connecting hole of the rocker arm, and under this state, the position of the annular groove in the first connecting hole is as high as the threaded holes; studs are connected into the threaded holes; under the connected state, one end, which is far from the slider, of the rocker arm shaft is not higher than the upper surface of the rocker arm, one end of each stud is located in the annular groove, and the other end is not higher than the sidewall surface of the rocker arm.

10. The electromagnetic release door closer according to claim 9, wherein one end, which is far from the slider, of the rocker arm is provided with a second connecting hole running through the rocker arm, the electromagnetic release door closer also comprises a hexagonal tenon, one end of the hexagonal tenon extends into the second connecting hole and is connected fixedly with the rocker arm, the length of extension of the hexagonal tenon into the second connecting hole is less than the axial length of the second connecting hole, and a countersink washer is arranged in one side, which is far from the hexagonal tenon, of the second connecting hole.

11. The electromagnetic release door closer according to claim 1, wherein both ends of the slide rail are provided with a horizontal mounting hole and a vertical mounting hole which are perpendicular to each other.

12. The electromagnetic release door closer according to claim 11, wherein one end, which is connected with the slider, of the rocker arm is provided with a first connecting hole running through the rocker arm, and the sidewall of the first connecting hole is provided with at least two threaded holes which are perpendicular to the first connecting hole and run through the sidewall of the first connecting hole.

13. The electromagnetic release door closer according to claim 12, wherein a rocker arm shaft is arranged between the rocker arm and the slider, the rocker arm shaft is provided with an annular groove, one end of the rocker arm shaft is connected fixedly with the slider, the end with the annular groove extends into the first connecting hole of the rocker arm, and under this state, the position of the annular groove in the first connecting hole is as high as the threaded holes; studs are connected into the threaded holes; under the connected state, one end, which is far from the slider, of the rocker arm shaft is not higher than the upper surface of the rocker arm, one end of each stud is located in the annular groove, and the other end is not higher than the sidewall surface of the rocker arm.

14. The electromagnetic release door closer according to claim 13, wherein one end, which is far from the slider, of the rocker arm is provided with a second connecting hole running through the rocker arm, the electromagnetic release door closer also comprises a hexagonal tenon, one end of the hexagonal tenon extends into the second connecting hole and is connected fixedly with the rocker arm, the length of extension of the hexagonal tenon into the second connecting hole is less than the axial length of the second connecting hole, and a countersink washer is arranged in one side, which is far from the hexagonal tenon, of the second connecting hole.

15. The electromagnetic release door closer according to claim 1, wherein both ends of the slide rail are provided with a horizontal mounting hole and a vertical mounting hole which are perpendicular to each other.

16. The electromagnetic release door closer according to claim 1, wherein one end, which is far from the slider, of the rocker arm is provided with a second connecting hole running through the rocker arm, the electromagnetic release door closer also comprises a hexagonal tenon, one end of the hexagonal tenon extends into the second connecting hole and is connected fixedly with the rocker arm, the length of extension of the hexagonal tenon into the second connecting hole is less than the axial length of the second connecting hole, and a countersink washer is arranged in one side, which is far from the hexagonal tenon, of the second connecting hole.

17. The electromagnetic release door closer according to claim 1, characterized in that one end, which is connected with the slider, of the rocker arm is provided with the first connecting hole running through the rocker arm, and a sidewall of the first connecting hole is provided with the threaded holes which are perpendicular to the first connecting hole and run through the sidewall of the first connecting hole.

* * * * *